US006623240B2

(12) United States Patent
Ertl et al.

(10) Patent No.: US 6,623,240 B2
(45) Date of Patent: Sep. 23, 2003

(54) GUIDE BLADE-ADJUSTING DEVICE FOR A TURBOCHARGER

(75) Inventors: Stefan Ertl, Magstadt (DE); Roland Schacherer, Geisingen (DE); Achim Voges, Waiblingen (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 10/056,425

(22) Filed: Jan. 24, 2002

(65) Prior Publication Data

US 2002/0098081 A1 Jul. 25, 2002

(30) Foreign Application Priority Data

Jan. 24, 2001 (DE) ..... 101 04 176

(51) Int. Cl.[7] ..... F01D 17/16
(52) U.S. Cl. ..... 415/163
(58) Field of Search ..... 415/159, 163, 415/164, 162

(56) References Cited

U.S. PATENT DOCUMENTS 4,659,295 A * 4/1987 Burdette et al. ..... 417/407
4,804,316 A * 2/1989 Fleury ..... 417/407
6,471,470 B2 * 10/2002 Yoshimura et al. ..... 415/160

FOREIGN PATENT DOCUMENTS

EP 0 226 444 4/1991
GB 0731822 A * 6/1955

* cited by examiner

*Primary Examiner*—Edward K. Look
*Assistant Examiner*—Dwayne J. White
(74) *Attorney, Agent, or Firm*—Collard & Roe, P.C.

(57) ABSTRACT

A guide blade-adjusting device for a turbocharger has an adjusting ring that is guided in a simple manner on the guide blade carrier plate. The adjusting ring comprises noses projecting in the axial direction. At least one the noses radially guides the adjusting ring on the guide blade carrier plate.

4 Claims, 2 Drawing Sheets

GUIDE BLADE-ADJUSTING DEVICE FOR A TURBOCHARGER

BACKGROUND OF THE INVENTION

1. Field of the Invention

The invention relates to a device for adjusting the guide blade of a turbocharger with a variable geometry of the turbine.

2. The Prior Art

Devices for adjusting guide blades adapt the characteristic of the charger to the volume of the flow of exhaust gases. Such an adjusting device is known from European Patent No. EP 2 26 444, where the adjusting ring is centered via rollers that are supported in the plate supporting the guide blade by means of plug-type axles. Such guidance requires great expenditure in the manufacturing and assembly operations.

SUMMARY OF THE INVENTION

It is therefore an object of the invention to provide a device for adjusting the guide blade in a radial manner in a simple way.

This object is accomplished according to the invention via a guide blade adjusting device for a turbocharger with a variable turbine geometry, comprising a guide blade carrier plate, a plurality of guide blades which are connected with guide blade levers via guide blade axles supported in the guide blade carrier plate, as well as a guide blade-adjusting ring. The adjusting ring has recesses for receiving the ends of the guide blade levers. The adjusting ring is guided with respect to the guide blade carrier plate. The adjusting ring comprises noses projecting in the axial direction. At least one nose effects the radial guidance of the adjusting ring on the guide blade carrier plate.

The aim is to permit the novel guide blade adjusting device to be transported in the form of a module and to be installed in a housing of an exhaust gas turbine.

The noses molded onto the adjusting ring in the area of the recesses for receiving the lever ends can be simultaneously formed on the adjusting ring by the displace material when the recesses are produced by punching, i.e. the recesses and the noses are produced in one single production step.

The recess can be produced by turning and realized in the form of a groove as well.

It is advantageous if the recess in the plate supporting the guide blade is turned into the area of the contact points of the noses in a crowned (or spherical) form, so that the adjusting rings will rest against the guide blade carrier plate in a point-shaped form.

The radial and the axial guidance of the adjusting rings has to be dimensioned so that the adjustment ring has axial and radial play under all operating conditions, so that it cannot get locked on the guide blade carrier plate.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
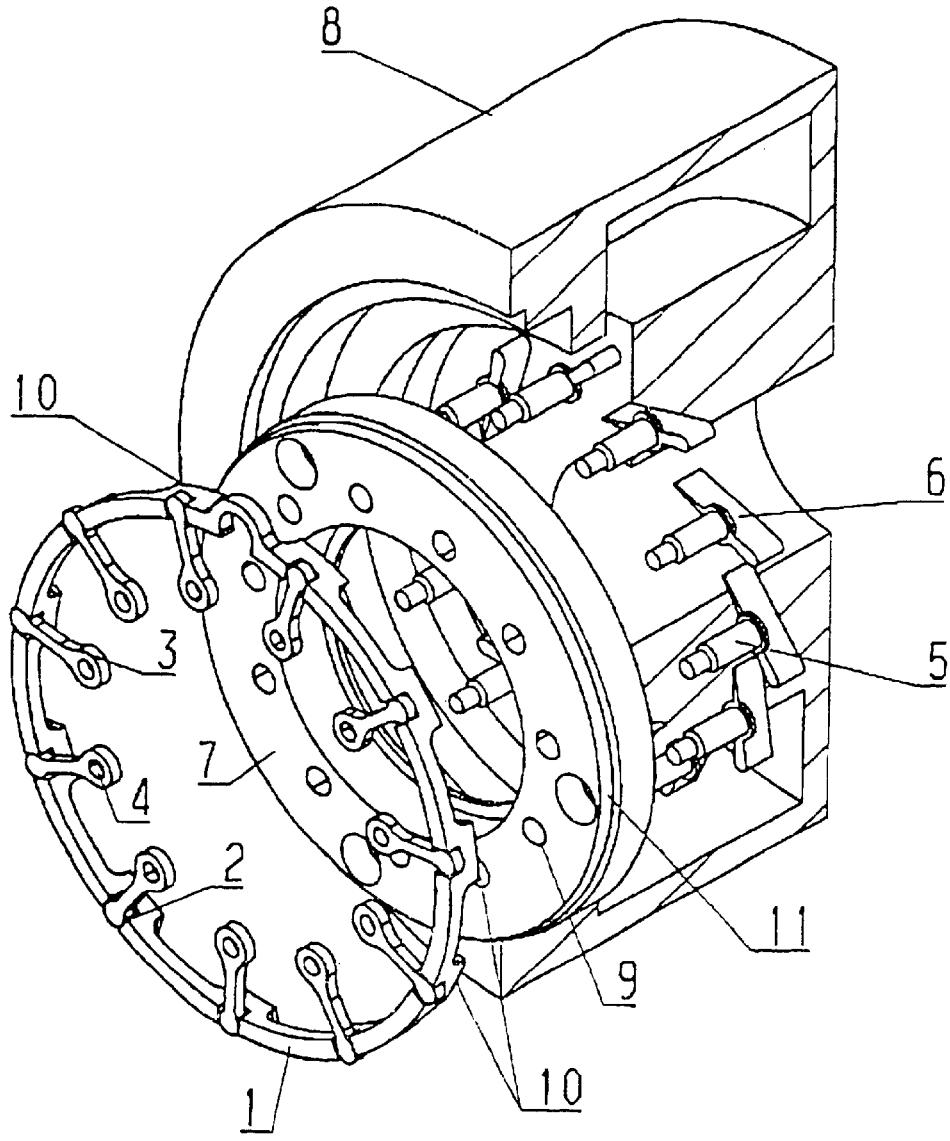
FIG. 1 shows a guide blade-adjusting device as defined by the invention with a schematically shown turbine housing prior to its assembly.

Referring now in detail to the drawings, FIG. 1 shows an adjusting ring 1 having recesses 2 for receiving the ends of guide blade levers 3. Guide blade levers 3 have drilled holes (or bores) 4 for receiving the ends of guide blade axles 5, which are connected with guide blades 6. The blade axles 5 are supported in drilled holes 9 in a guide blade carrier plate 7, which is screwed to housing part 8 (the screws are not shown).

In the axial direction toward the housing, adjusting ring 1 comprises projecting noses 10, which guide the adjusting ring radially in a crown-shaped recess 11 produced in the guide blade carrier plate by turning.

Figure 2:
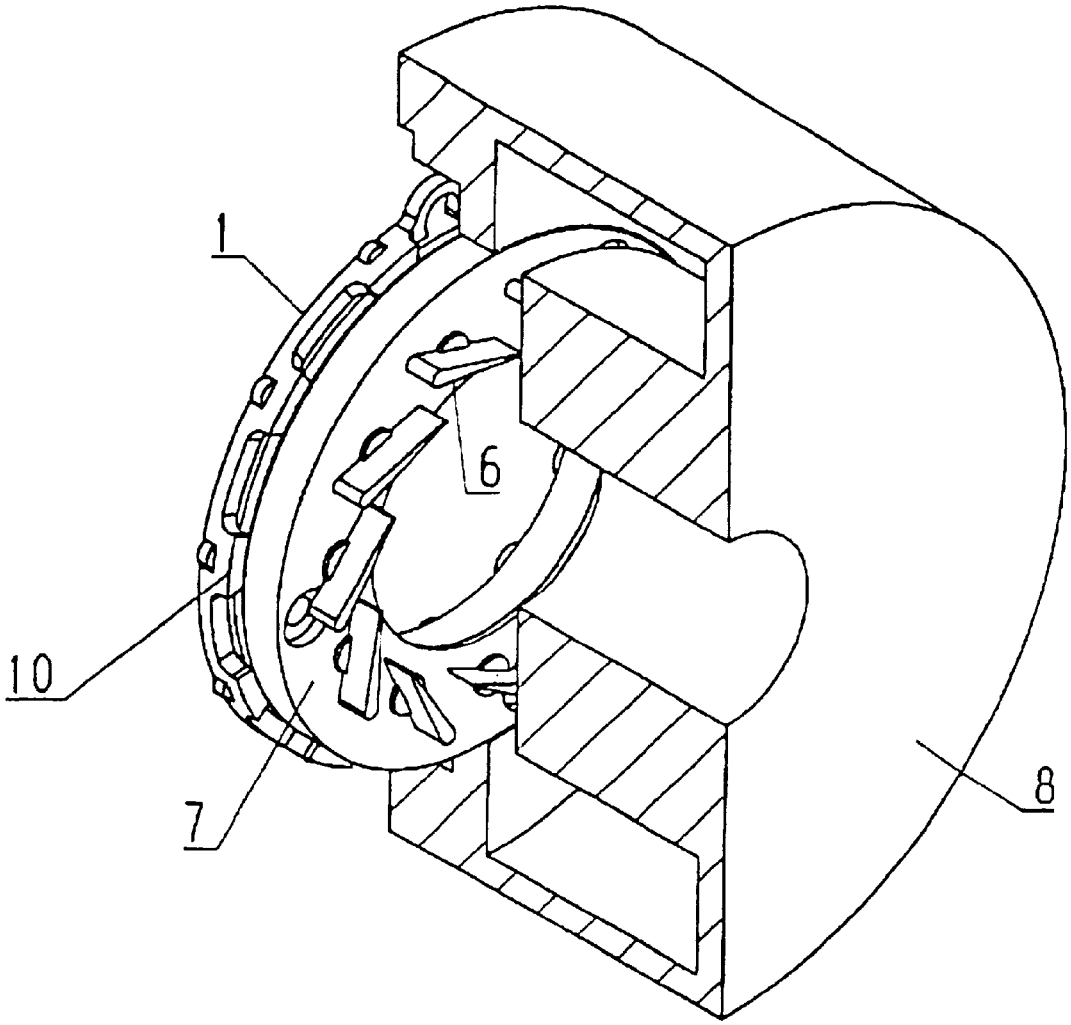
FIG. 2 shows the assembled guide blade-adjusting device.

In the assembled condition according to FIG. 2, guide blade axles 5 are joined with guide blade levers 3 by welding, soldering or riveting.

It is therefore possible to produce, transport and install the construction unit comprising the guide blade carrier plate, the guide blades, the guide blade levers and the adjusting ring in the form of a module, whereby the individual components are connected with the guide blade carrier plate in a manner such that they cannot be lost after the axles and the levers of the guide blades have been connected.

Accordingly, while only a single embodiment of the present invention has been shown and described, it is obvious that many changes and modifications may be made thereunto without departing from the spirit and scope of the invention.

What is claimed is:

1. A guide blade-adjusting device for a turbocharger with a variable turbine geometry, comprising:

a guide blade carrier plate;

a plurality of guide blades connected with guide blade levers via guide blade axles, said guide blades being supported in the guide blade carrier plate; and a guide blade-adjusting ring comprising recesses for receiving ends of the guide blade levers, said adjusting ring being guided with respect to the guide blade carrier plate;

wherein the adjusting ring comprises noses projecting in an axial direction, wherein at least one of said noses radially guides said adjusting ring on said guide blade carrier plate.

2. The guide blade-guiding device according to claim 1, wherein the noses are located near at least some of the recesses.

3. The guide blade-adjusting device according to claim 1, wherein the guide blade carrier plate has a recess produced by turning, on which the adjusting ring is radially guided.

4. The guide blade-adjusting device according to claim 3, wherein the recess has a crown shape.

* * * * *